US008640682B2

(12) United States Patent
Shirk, II

(10) Patent No.: US 8,640,682 B2
(45) Date of Patent: Feb. 4, 2014

(54) MULTIPURPOSE SLINGSHOT

(76) Inventor: Cort John Shirk, II, Dallas, TX (US)

( * ) Notice: Subject to any disclaimer, the term of this patent is extended or adjusted under 35 U.S.C. 154(b) by 41 days.

(21) Appl. No.: 13/361,537

(22) Filed: Jan. 30, 2012

(65) Prior Publication Data

US 2013/0192572 A1 Aug. 1, 2013

(51) Int. Cl.
*F41B 3/02* (2006.01)

(52) U.S. Cl.
USPC ..... 124/20.1

(58) Field of Classification Search
USPC ..... 124/20.1, 20.2
See application file for complete search history.

(56) References Cited

U.S. PATENT DOCUMENTS

| | | | | |
|---|---|---|---|---|
| 3,270,734 | A * | 9/1966 | Clements | 124/20.2 |
| 4,583,513 | A * | 4/1986 | Ellenburg et al. | 124/20.2 |
| 6,786,213 | B1 | 9/2004 | Lee | |
| 7,543,579 | B2 * | 6/2009 | Chang | 124/20.2 |
| 2003/0034019 | A1 * | 2/2003 | Lewis | 124/20.1 |

* cited by examiner

*Primary Examiner* — John Ricci
(74) *Attorney, Agent, or Firm* — Yee & Associates, P.C.

(57) ABSTRACT

An apparatus comprising an elongate member, a first arm, a second arm, a channel, and a cap. The elongate member has a first end and a second end. The first arm and the second arm extend from the first end. A space is present between the first arm and the second arm over the first end. The channel extends through the elongate member. The channel is in communication with an opening in the second end of the elongate member. The cap is configured to be secured to the second end and substantially seal the opening in the second end.

13 Claims, 10 Drawing Sheets

MULTIPURPOSE SLINGSHOT

BACKGROUND INFORMATION

1. Field

The present disclosure relates generally to projectile devices and, in particular, to slingshots. Still more particularly, the present disclosure relates to a multipurpose slingshot for hunting, fishing, and outdoor survival.

2. Background

Various types of equipment may be used when performing outdoor activities. These outdoor activities may include, for example, hunting, fishing, camping, hiking, outdoor recreational activities, and/or outdoor survival activities. Equipment such as rifles, fishing rods, knives, and other types of tools are currently used for these outdoor activities.

As one example, an outdoor recreational activity may include using a slingshot for hunting, fishing, outdoor survival, or other activities. A slingshot is a device that shoots a projectile at a target. As currently implemented, slingshots are typically constructed to serve the purpose of toys and/or simple weapons.

However, slingshots currently may not be as useful as desired for outdoor activities. For example, current slingshot designs are not directed towards maximum compactness for storage when outdoors. When performing outdoor activities, it is often desirable to carry items such as a backpack, water, food, and other items. However, the number of items that can be carried may be limited based on the physical constraints for carrying items. More specifically, the amount of space in a backpack, bag, or other storage equipment may not provide as much space as desired. More space is needed in a backpack or bag carried by a person as the number of items increases. The size of the backpack or bag limits the space that is present for items.

Depending on the activities planned for a trip, the amount of space taken up by a slingshot may not leave sufficient space for other items that a person may wish to carry. As a result, some items may not be carried or additional equipment may be needed to carry the desired items.

Therefore, it would be advantageous to have a method and apparatus that takes into account at least some of the issues discussed above, as well as other possible issues.

SUMMARY

In one illustrative embodiment, an apparatus comprises an elongate member, a first arm, a second arm, a channel, and a cap. The elongate member has a first end and a second end. The first arm and the second arm extend from the first end. A space is present between the first arm and the second arm over the first end. The channel extends through the elongate member. The channel is in communication with an opening in the second end of the elongate member. The cap is configured to be secured to the second end and substantially seal the opening in the second end.

In another illustrative embodiment, a sling shot system comprises a tube, a first arm, a second arm, a channel, a cap, a sealing mechanism, and a set of containers. The tube has a first end and a second end. The first arm and the second arm extend from the first end. A space is present between the first arm and the second arm over the first end. The channel extends through an elongate member. The channel is in communication with an opening in the second end of the elongate member. The cap is configured to be secured to the second end and substantially seal the opening in the second end. The sealing mechanism is configured to seal the channel when the cap is secured to the second end. The set of containers is configured for placement inside of the channel when the cap is secured to the second end. A container in the set of containers is configured to hold an item.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and advantages thereof, will best be understood by reference to the following detailed description of an illustrative embodiment of the present disclosure when read in conjunction with the accompanying drawings, wherein:

DETAILED DESCRIPTION

The different illustrative embodiments recognize and take into account a number of different considerations. For example, the illustrative embodiments recognize and take into account that additional backpacks or bags may be used to carry desired items. For example, a person may bring an additional bag or backpack so that all of the items that the person may desire to have for different activities can be carried. The different illustrative embodiments recognize and take into account, however, that additional equipment for carrying items may be more cumbersome that desired.

Thus, the different illustrative embodiments recognize and take into account that combining the functions of some items may be useful in reducing the number of items needed to be carried for various activities. The different illustrative embodiments recognize and take into account that a slingshot may be configured to have multiple functions. With this configuration, fewer items may be carried to perform different activities such as hunting, fishing, outdoor survival, and/or other suitable activities.

Figure 1:
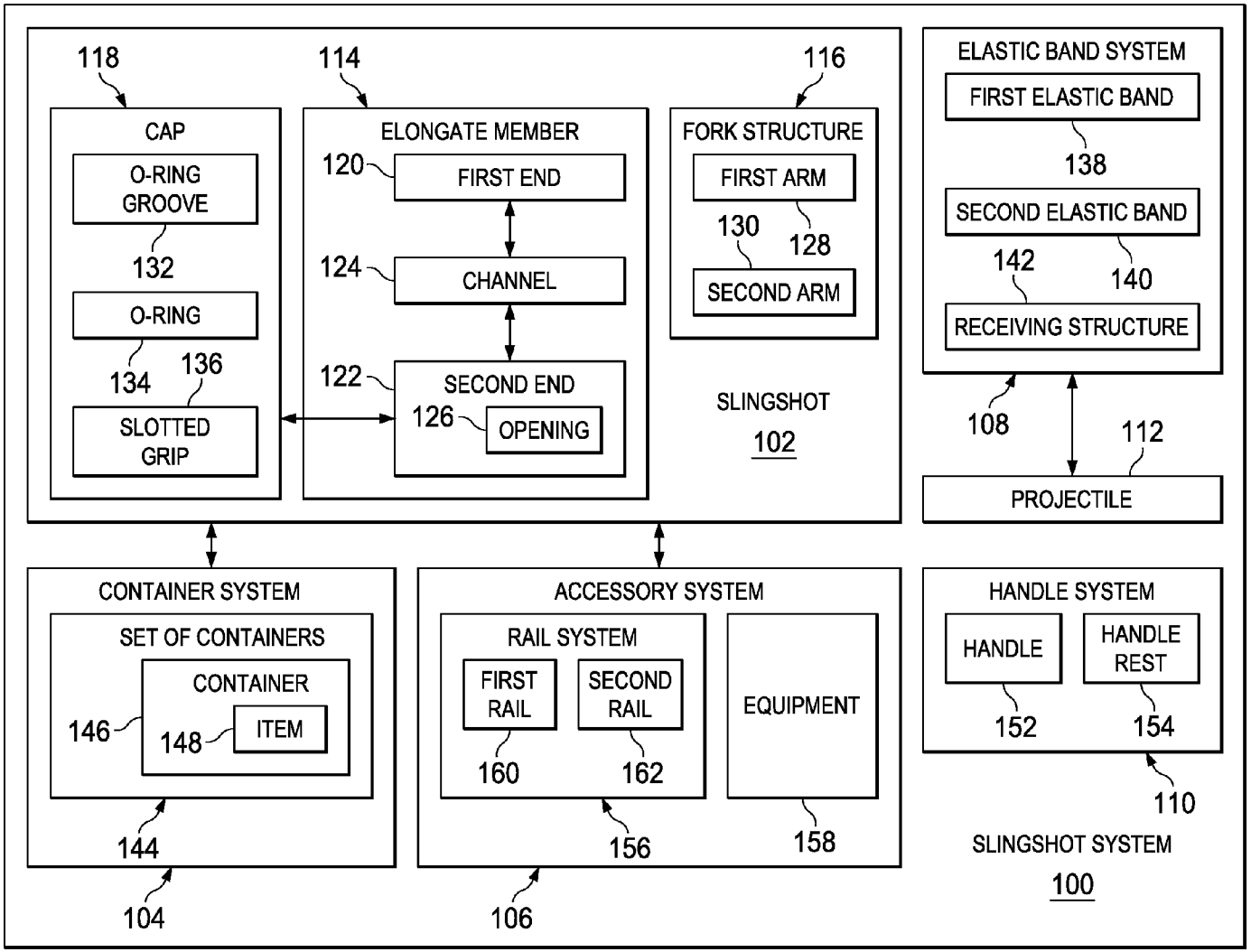
FIG. 1 is an illustration of a block diagram of a slingshot system in accordance with an illustrative embodiment.

With reference now to the figures, and in particular with reference to FIG. 1, a block diagram of a slingshot system is depicted in accordance with an illustrative embodiment. In this illustrative example, slingshot system 100 is shown in block form to illustrate functional components that may be present in slingshot system 100.

In this depicted example, slingshot system 100 comprises slingshot 102, container system 104, accessory system 106, elastic band system 108, and handle system 110.

In this depicted example, container system 104 may be used inside of slingshot 102. Accessory system 106 may be used to provide additional functionality to slingshot 102. Elastic band system 108 may be used to fire projectile 112 from slingshot 102. Handle system 110 may be used to provide a user with increased leverage and stability when firing projectile 112 from slingshot 102.

In this illustrative example, slingshot 102 comprises elongate member 114, fork structure 116, and cap 118. Elongate member 114 has first end 120 and second end 122. Channel 124 extends through elongate member 114. In these illustrative examples, channel 124 is in communication with opening 126 located at second end 122 of elongate member 114. Fork structure 116 is associated with first end 120 of elongate member 114. The association is a physical association in these depicted examples. A first component may be considered to be associated with a second component by being secured to the second component, bonded to the second component, mounted to the second component, welded to the second component, fastened to the second component, and/or connected to the second component in some other suitable manner. The first component also may be connected to the second component using a third component. The first component also may be considered to be associated with the second component by being formed as part of and/or an extension of the second component.

In this illustrative example, fork structure 116 comprises first arm 128 and second arm 130. First arm 128 and second arm 130 may be part of a single component or may be separate components in these illustrative examples. Cap 118 is configured to be secured to second end 122 of elongate member 114. Cap 118 is configured to substantially seal opening 126 in elongate member 114. Cap 118 may have o-ring groove 132 for retaining o-ring 134.

In this illustrative example o-ring 134 is a sealing mechanism. When secured to opening 126, cap 118 may provide a seal that may be substantially water-tight for channel 124 within elongate member 114. Cap 118 also may be configured with slotted grip 136 to aid in fastening cap 118 to second end 122.

Elastic band system 108 is configured to hold projectile 112. In these illustrative examples, elastic band system 108 comprises first elastic band 138, second elastic band 140, and receiving structure 142. Receiving structure 142 is the particular portion of elastic band system 108 that is configured to hold projectile 112.

First elastic band 138 has a front end that is associated with first arm 128 and a back end that is associated with receiving structure 142. Second elastic band 140 has a front end that is associated with second arm 130 and a back end that is associated with receiving structure 142.

In these illustrative examples, first elastic band 138 and second elastic band 140 may be flat bands, tubular bands, or other suitable types of bands that have a desired amount of elasticity. For example, first elastic band 138 and second elastic band 140 may be latex surgical tubing having a diameter that is about 7/16 inch, about ½, inch or some other suitable diameter.

Receiving structure 142 may be a pocket, a leather pouch, or some other suitable type of structure that is configured to hold or receive projectile 112. Receiving structure 142 may be configured for ease of fastening to elastic band system 108. For example, receiving structure 142 may comprise one or more connectors for fastening receiving structure 142 to elastic band system 108.

In these illustrative examples, projectile 112 may take one or more different forms. For example, without limitation, projectile 112 may be selected from buckshot, steel pellets, a BB, an arrow, a rock, a steel ball bearing, or other suitable types of projectiles. In these illustrative examples, an arrow may be configured for fishing, target practice, and any other suitable purpose.

In these illustrative examples, elongate member 114 may take various forms. For example, elongate member 114 may be a metal tube. In other illustrative examples, elongate member 114 may have a different cross-section than a circle bound in a tube. For example, elongate member 114 may have an octagonal shape, a hexagonal shape, an oval shape, or some other suitable shape for a user to hold slingshot 102.

In these illustrative examples, container system 104 comprises set of containers 144. As used herein, a set, with reference to items, means one or more items. Set of containers 144, in these illustrative examples, may be one or more containers.

In these examples, set of containers 144 has a shape that allows for placement of one or more of set of containers 144 through opening 126 into channel 124 such that set of containers 144 may be held within channel 124 when cap 118 is secured to second end 122.

As depicted, a container within set of containers 144 may be transparent or translucent. Thus, container 146 within set of containers 144 may hold item 148. In this manner, a user may be able to identify or see item 148 within container 146. In these illustrative examples, container 146 also is sealable and may provide a water-tight, air-tight, or some other desired type of sealing.

Item 148 may take different forms depending on the need of the user. For example, item 148 may be selected from one of a projectile, a first aid kit, a knife, food, water, a fishing line, a fishing hook, a flashlight, and any other suitable items.

Handle system 110 comprises handle 152 and handle rest 154. Handle rest 154 is configured to provide a user with additional comfort and stability when using handle 152 as a leverage point to fire projectile 112 from slingshot 102.

Handle 152 is associated with second end 122 of elongate member 114. Second end 122 of elongate member 114 is configured to fasten handle 152 in a first position that is suitable for providing a user with leverage for firing projectile 112 from slingshot 102. For example, second end 122 of elongate member 114 may have a slot which is configured to fasten handle 152 to second end 122 of elongate member 114 using friction. In these illustrative examples, a first position that is suitable for providing a user with leverage for firing projectile 112 from slingshot 102 is also suitable for allowing slingshot 102 to remain standing on a flat surface when not being held by a user.

Second end 122 of elongate member 114 also is configured to fasten handle 152 in a second position that is more compact than the first position. In other words, the second position is suitable for travel. The association of handle 152 with second end 122 may comprise forming a hinge between second end 122 and handle 152. In other words, the configuration of second end 122 allows a user to manually rotate handle 152 between the first position and second position.

Accessory system 106 comprises rail system 156 and equipment 158. Rail system 156 comprises one or more rails associated with first end 120 that are used to attach equipment 158 to slingshot 102. Equipment 158 may be used to provide additional functionality to slingshot 102. For example, equipment 158 may include one or more of a fishing reel, a flashlight, an aiming stabilizer, a night vision aid, a sound amplifier, a laser sight, a rangefinder, a projectile container, an arrow quiver, and any other accessory suitable for hunting, fishing, and outdoor survival.

In these illustrative examples, rail system 156 may include first rail 160 and second rail 162. First rail 160 and second rail 162 may be fastened to first end 120 of elongate member 114. First rail 160 and second rail 162 may be used, alone or in combination, to provide additional functionality to slingshot 102. First rail 160 and second rail 162 may provide additional functionality by providing a bracket for mounting one or more accessories. First rail 160 and second rail 162 may be configured as a standard or custom rail mount type.

Standard rail mount types may include, for example, Weaver, Picatinny, MIL-STD-1913, and other suitable rail mount types. For example, first rail 160 may be of the weaver type. In this illustrative example, any suitable accessory compatible with weaver rails may be attached to first rail 160. More specifically, an illustrative example of a suitable accessory may include, for example, a fishing reel used to reel in a fishing line attached to a fishing arrow.

The configuration of first end 120 of elongate member 114 may include the ability to mount first rail 160 perpendicular to or in parallel with elongate member 114. The configuration of first end 120 of elongate member 114 also may include the ability to mount second rail 162 perpendicular to or in parallel with elongate member 114.

Further, the configuration of first end 120 of elongate member 114 may include the ability to mount first rail 160 and second rail 162 in parallel with each other on opposite sides of first end 120. Further, the configuration of first end 120 of elongate member 114 may include the ability to mount first rail 160 and second rail 162 perpendicular to or in parallel with fork structure 116.

The illustration of slingshot system 100 in FIG. 1 is not meant to imply physical or architectural limitations to the manner in which an illustrative embodiment may be implemented. Other components in addition to and/or in place of the ones illustrated may be used. Some components may be unnecessary in some implementations. Also, the blocks are presented to illustrate some functional components. One or more of these blocks may be combined and/or divided into different blocks when implemented in an illustrative embodiment.

For example, handle system 110 may be an optional component of slingshot system 100. In these illustrative embodiments, an optional component means that the component may be added, removed, or not present at all. Further, handle rest 154 may be an optional component of handle system 110.

Figure 2:
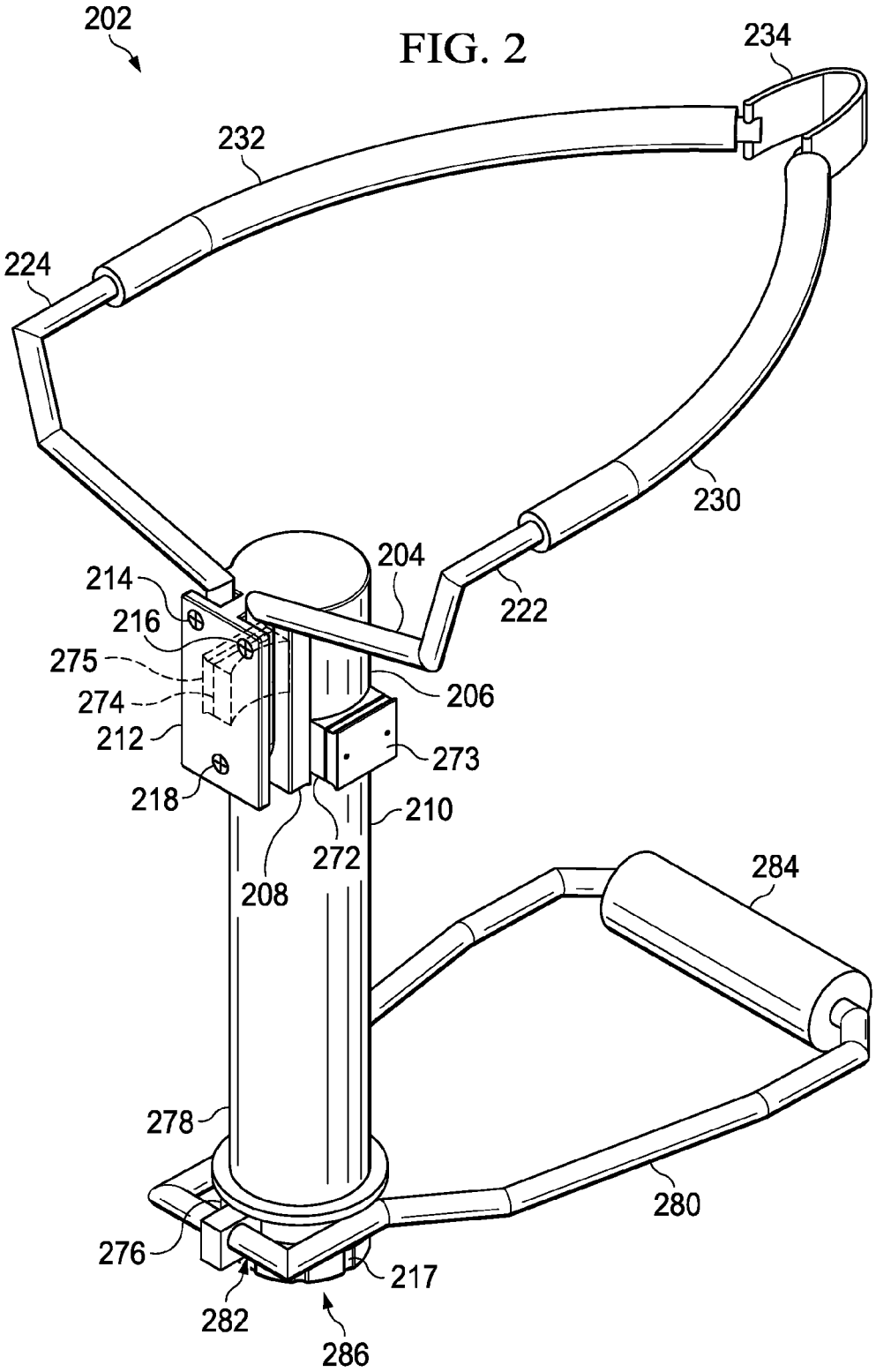
FIG. 2 is an illustration of an isometric view of a slingshot in accordance with an illustrative embodiment.

Referring now to FIG. 2, an illustration of an isometric view of a slingshot is depicted in accordance with an illustrative embodiment. Some of the components in this figure may be illustrative examples of how components shown in block form in FIG. 1 can be implemented as physical structures.

As depicted, slingshot 202 is an example of a physical implementation of slingshot 102 in slingshot system 100 shown in block form in FIG. 1. Fork structure 204 is attached to first end 206 of slingshot 202 at protrusion 208 of elongate member 210. Fork structure 204 is attached using plate 212 and fasteners 214, 216, and 218.

In this illustrative example, plate 212 and protrusion 208 are configured to hold fork structure 204 to elongate member 210. In other illustrative examples, the configuration of plate 212, protrusion 208, fasteners 214, 216, and 218 and the location of fasteners 214, 216, and 218 may be changed. For example, plate 212 may be configured such that only two fasteners are used. Further, fork structure 204 may be attached to first end 206 of slingshot 202 without using a plate and without using fasteners. For example, the configuration of fork structure 204 and protrusion 208 may allow for fork structure to remain fully attached to protrusion 208 without using fasteners. For example, a tight fit between fork structure 204 and protrusion 208 may be used. In this example, when fork structure 204 is inserted onto protrusion 208, fork structure 204 is firmly fastened to first end 206 of slingshot 202 without using fasteners 214, 216, and 218.

First elastic band 230 is attached to first arm 222 and receiving structure 234. Second elastic band 232 is attached to second arm 224 and receiving structure 234. In this illustrative example, first elastic band 230 and second elastic band 232 are constructed of latex surgical tubing.

As depicted, protrusion 272 on first end 206 of elongate member 210 of slingshot 202 is configured for attaching a rail system for adding equipment to slingshot 202. Rail 273 is fastened to protrusion 272 of elongate member 210. Rail 273 is an example of a physical implementation of second rail 162 in FIG. 1. Protrusion 274 is illustrated in shadow box form on FIG. 2. Protrusion 274 is used for attaching a rail system for adding equipment to slingshot 202. Rail 275 is fastened to protrusion 274 of elongate member 210. Rail 275 is an example of a physical implementation of first rail 160 in FIG. 1. Rail 275 and rail 273 may be used, alone or in combination, as brackets for mounting equipment to slingshot 202.

As depicted, Protrusion 276 on second end 278 of slingshot 202 is configured to fasten handle 280 to slingshot 202.

In FIG. 2, handle 280 is depicted in an open position that is perpendicular to elongate member 210. The open position is suitable for providing a user with leverage for firing projectiles. Protrusion 276 may take the form of hinge 282. Hinge 282 allows handle 280 to be rotated to the open position and the closed position.

In the closed position, handle 280 is rotated about hinge 282 until handle 280 contacts with fork structure 204. In this illustrative example, handle rest 284 covers handle 280. Handle rest 284 is placed on the end of handle 280 that is opposite from the end of handle 280 inside of hinge 282. Handle rest 284 provides a user with additional comfort and stability when using handle 280 as a leverage point to fire projectiles from slingshot 202.

In this illustrative example, handle reset 284 is constructed of neoprene. In this and other illustrative examples, handle rest 284 also may be constructed of leather, rubber, foam wrapped in water tight fabric, and any other suitable material or combination of materials.

Cap 286 is an example of a physical implementation of cap 118 in FIG. 1. Cap 286 is used to substantially seal elongate member 210. Cap 286 has slotted grip 217.

As depicted, elongate member 210, plate 212, fork structure 204, and handle 280 are constructed of aluminum. In this and other illustrative examples, the components of slingshot 202 also may be constructed using any suitable material. For example, the material may be selected from at least one of a metal, an alloy, a composite material, polycarbonate, aluminum, steel, carbon fiber, titanium, and any other suitable material or combination of materials.

As used herein, the phrase "at least one of", when used with a list of items, means different combinations of one or more of the listed items may be used, and only one of each item in the list may be needed. For example, "at least one of item A, item B, and item C" may include, for example, without limitation, item A or item A and item B. This example also may include item A, item B, and item C, or item B and item C.

In these illustrative examples, when receiving structure 234 is attached to elastic bands of sufficient strength, a user may pull back receiving structure 234 for firing a projectile with a higher amount of force than previous slingshot designs. For example, bench analysis of slingshot 202 has been included in appendix A, which shows 351*bs* of force being used to pull on back on receiving structure 234 of slingshot 202. This higher amount of force results in greater potential energy for projectiles fired from slingshot 202.

Figure 3A:
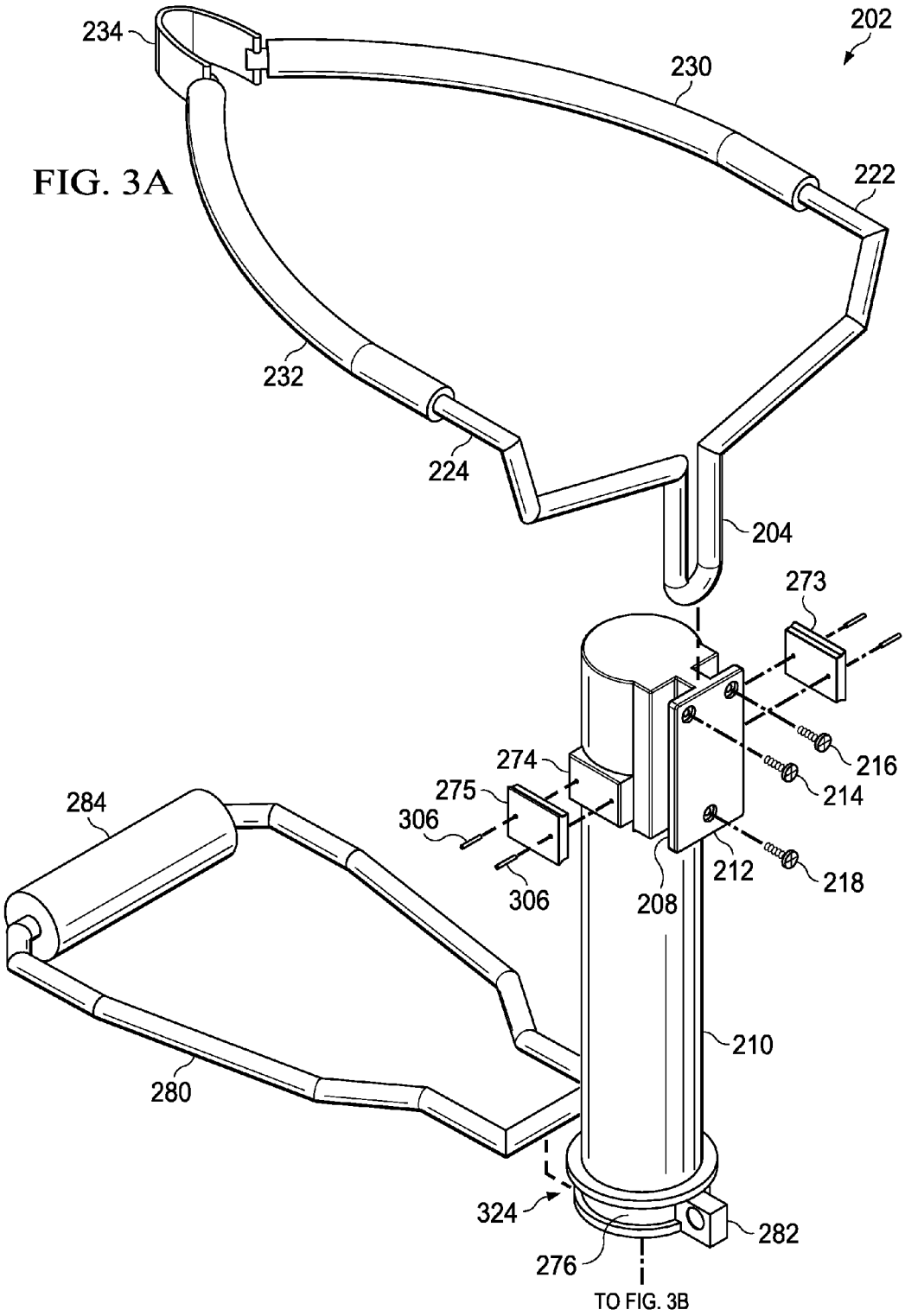
FIGS. 3A and 3B are an illustration of an exploded view of a slingshot in accordance with illustrative embodiment.

Referring now to FIG. 3A, an illustration of an exploded view of a slingshot is depicted in accordance with an illustrative embodiment. Some of the components in FIG. 3A are illustrative examples of the components shown in the isometric view of slingshot 202 of FIG. 2. In these illustrative examples, rail 275 is fastened to protrusion 274 of elongate member 210 by fasteners 306. Rail 273 is fastened to protrusion 272 of elongate member 210 by fasteners 306. Rail 275 is an example of a physical implementation of first rail 160 in FIG. 1. Rail 273 is an example of a physical implementation of second rail 162 in FIG. 1. Rail 275 and rail 273 may be used, alone or in combination, as brackets for mounting equipment to slingshot 202.

Figure 3B:
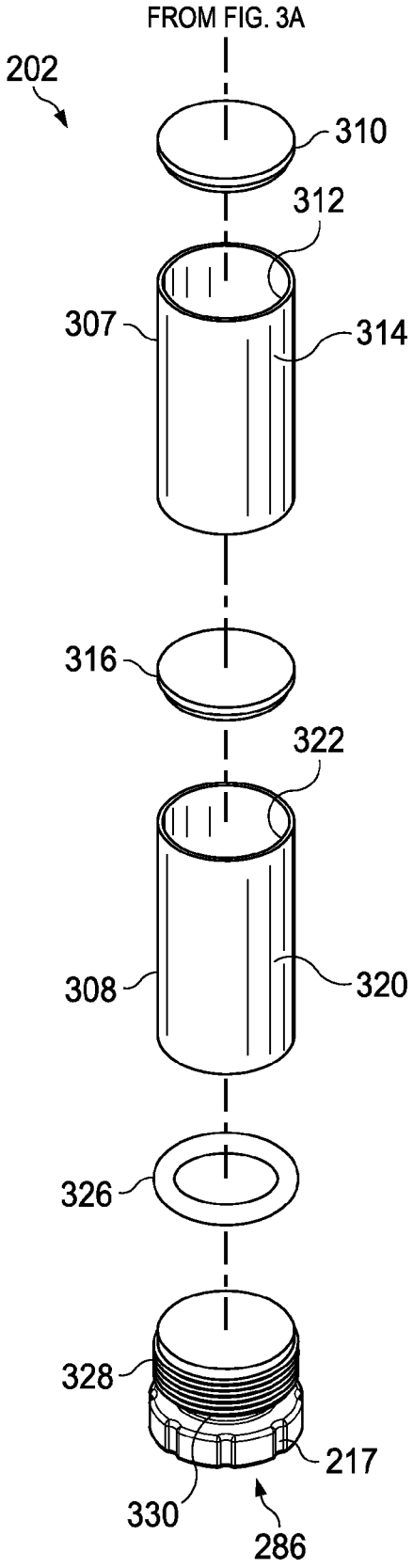

Referring now to FIG. 3B, an illustration of an exploded view of a slingshot is depicted in accordance with an illustrative embodiment. Some of the components in FIG. 3B are illustrative examples of the components shown in the isometric view of slingshot 202 of FIG. 2. Containers 307 and 308 are depicted in this illustrative example. Container 307 comprises lid 310 and receptacle 314. Container 308 comprises lid 316 and receptacle 320. Containers 307 and 308 are examples of physical implementations of container 146 in set of containers 144 shown in block form in FIG. 1.

In this illustrative example, lid 310 may be fastened to receptacle 314 to substantially seal opening 312 of receptacle 314. Lid 316 may be fastened to receptacle 320 to substantially seal opening 322 of receptacle 320.

Receptacles 314 and 320 may be inserted into opening 324 of elongate member 210. Lids 310 and 316 are configured to be inserted into opening 324 of elongate member 210 when attached to receptacles 314 and 320. In these illustrative examples, containers 307 and 308 may take one or more different forms. For example, containers 307 and 308 may take the form of sealed containers that have no lid, containers having a non-removable lid, stackable containers configured to use the bottom of another container as a lid, containers configured to use cap 286 as a lid, and any other containers suitable for insertion into elongate member 210.

FIG. 3B depicts an exploded view of cap 286. Cap 286 is an example of a physical implementation of cap 118 in FIG. 1. Cap 286 comprises o-ring 326, threads 328, and groove 330. O-ring 326 is an example of a physical implementation of o-ring 134 in FIG. 1. Groove 330 is an example of a physical implementation of o-ring groove 132 in FIG. 1. In this illustrative example, o-ring 326 may be placed on and around cap 286 in communication with groove 330. Cap 286 may then be fastened to opening 324 of elongate member 210.

Figure 4:
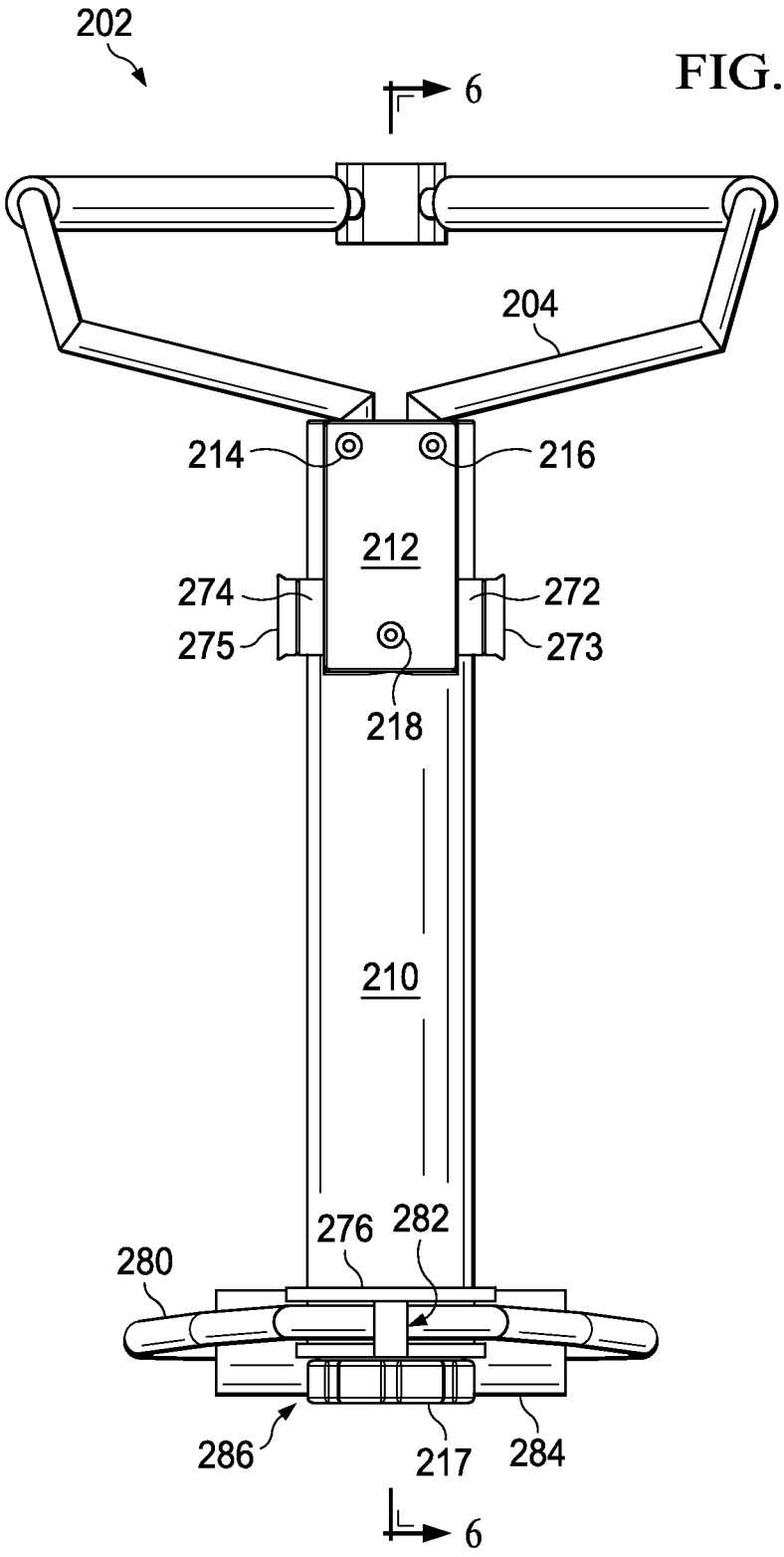
FIG. 4 is an illustration of a front view of a slingshot in accordance with an illustrative embodiment.

Referring now to FIG. 4, an illustration of a front view of a slingshot is depicted in accordance with an illustrative embodiment. Some of the components in FIG. 4 are illustrative examples of the components shown in the isometric view of slingshot 202 of FIG. 2.

Figure 5:
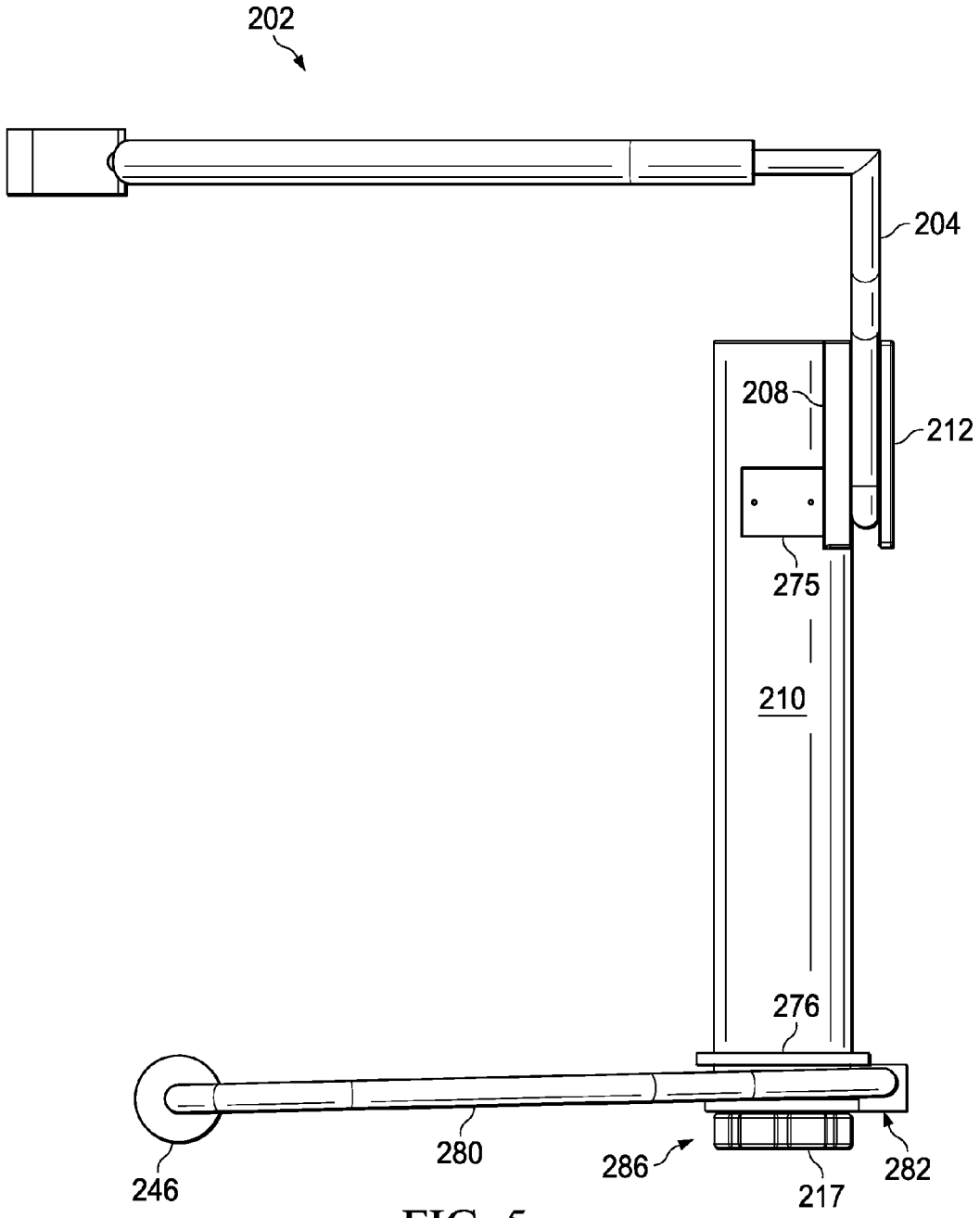
FIG. 5 is an illustration of a side view of a slingshot in accordance with an illustrative embodiment.

Referring to FIG. 5, an illustration of a side view of a slingshot is depicted in accordance with an illustrative embodiment. Some of the components in FIG. 5 are illustrative examples of the components shown in the isometric view of slingshot 202 of FIG. 2.

Figure 6:
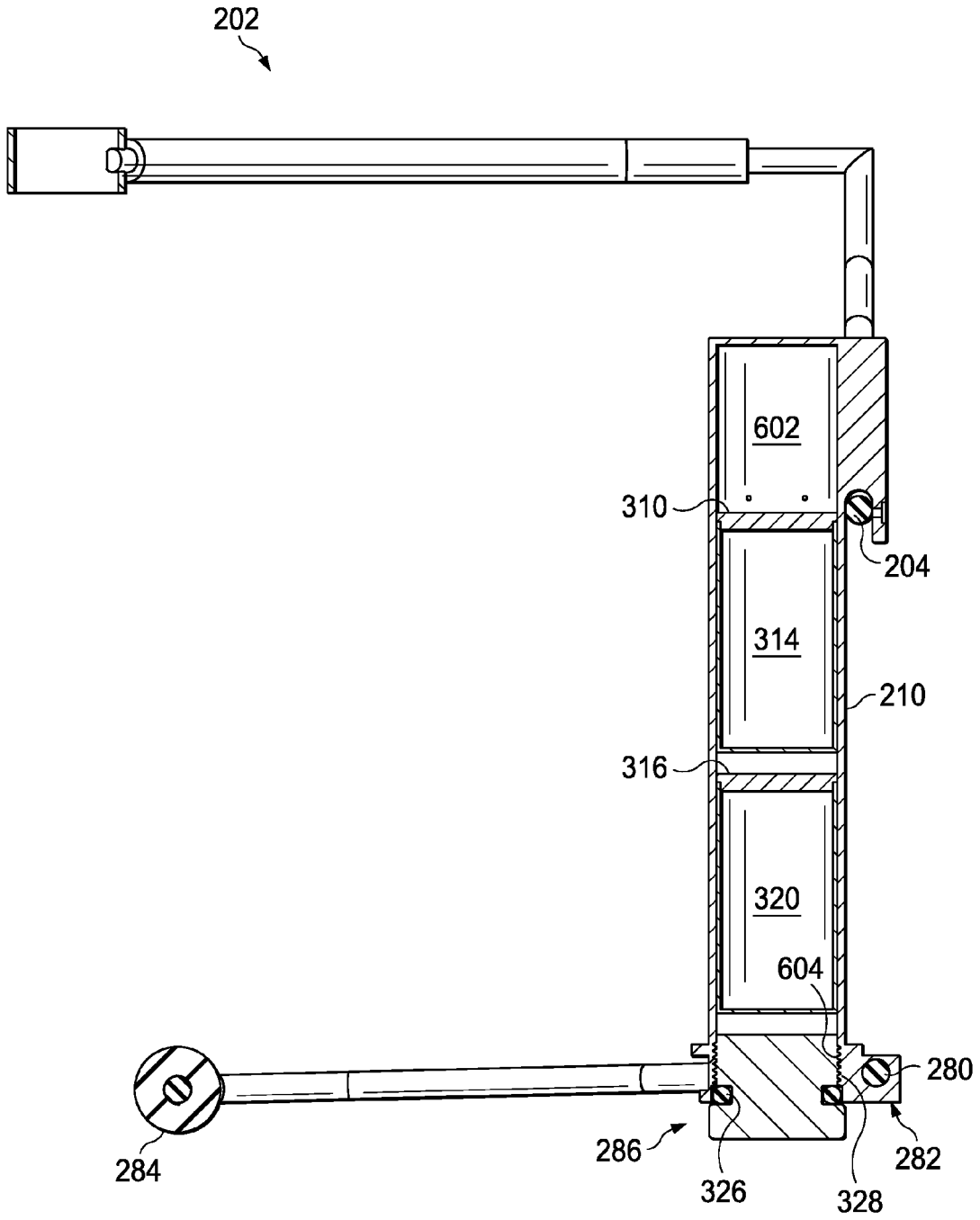
FIG. 6 is an illustration of a cross-section of a side view of a slingshot in accordance with an illustrative embodiment.

Referring to FIG. 6, an illustration of a cross-section of a side view of a slingshot is depicted in accordance with an illustrative embodiment. Some of the components in FIG. 6 are illustrative examples of the components shown in the isometric view of slingshot 202 of FIG. 2. FIG. 6 is a cross-sectional side view taken along lines 6-6 from FIG. 4. Other components in FIG. 6 are illustrative examples of the components shown in the exploded view of slingshot 202 of FIG. 3A and FIG. 3B. In addition to FIG. 2, FIG. 3A, and FIG. 3B components, FIG. 6 also shows channel 602 and channel grooves 604. Channel 602 is an example of a physical implementation of channel 124 in FIG. 1. Channel 602 extends through elongate member 210. Channel 602 comprises channel grooves 604, which are used to fasten cap 286 to substantially seal elongate member 210.

Figure 7A:
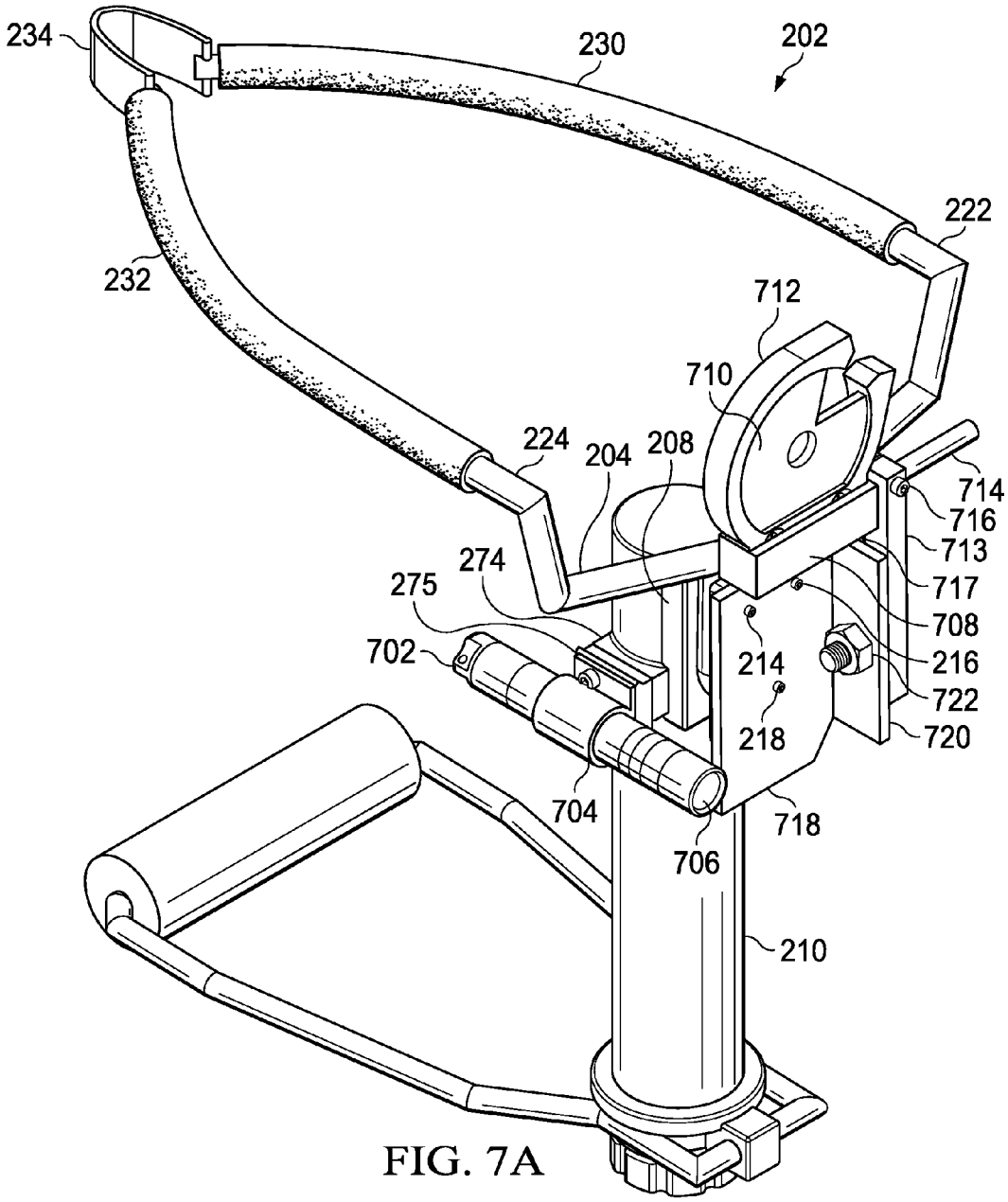
FIG. 7A is an illustration of an isometric view of a slingshot with a flashlight and an arrow rest in accordance with an illustrative embodiment.

Referring now to FIG. 7A, an illustration of an isometric view of a slingshot with a flashlight and an arrow rest in accordance with an illustrative embodiment is depicted. Some of the components in FIG. 7A are illustrative examples of the components shown in the isometric view of slingshot 202 of FIG. 2.

In these illustrative examples, flashlight 702 may be mounted to slingshot 202 using flashlight mount 704. As depicted, rail 275 may be used as a bracket to fasten flashlight mount 704 to protrusion 274 of elongate member 210 of slingshot 202. Flashlight lens 706 may be connected to flashlight 702.

In these illustrative examples, light from a light source in flashlight 702 passes through flashlight lens 706. As depicted, flashlight 702 is mounted to slingshot 202 in a configuration for shining light in front of slingshot 202. More particularly, flashlight 702 is mounted to slingshot 202 in a configuration suited for shining light on a target. For example, a user of slingshot 202 may use mounted flashlight 702 to shine light from flashlight 702 on a target. In these illustrative examples, the light from flashlight 702 may aid in finding, identifying, and aiming at a target before using slingshot 202 to fire a projectile at the target. In these illustrative examples, the light from flashlight 702 may be in the form of a wide beam of light and/or a narrow beam of light. For example, flashlight 702 may be used to shine both a narrowly focused beam of light, such as a laser, and also may also be used to shine a wide beam of light, such as from a light bulb, on an area in front of slingshot 202.

In these illustrative examples, arrow rest 708 may have bristles 710 which are attached to the inside of circular member 712 of arrow rest 708. In these illustrative examples, bristles 710 are attached inside of circular member 712 in a configuration for receiving and securing an arrow. For example, a user of slingshot 202 may use bristles 710 inside of circular member 712 of arrow rest 708 to hold an arrow in place while aiming at a target. Still more particularly, bristles 710 are arranged inside of circular member 712 of arrow rest 708 in a configuration for guiding an arrow when released from receiving structure 234 to a user identified target.

Still referring to FIG. 7A, arrow rest 708 may be mounted to elevation adjustment bracket 713 using rod member 714 of arrow rest 708 and fastener 716. For example, rod member 714 of arrow rest 708 may be inserted into vise joint 717 of elevation adjustment bracket 713 and then held in place by tightening vise joint 717 using fastener 716. In these illustrative examples, the amount of pressure applied by vise joint 717 on rod member 714 using fastener 716 may allow arrow rest 708 to be rotated relative to elevation adjustment bracket 713. For example, if fastener 716 is loosened, arrow rest 708 may be rotated between an up and ready to use position and down and out of the way position. Further, if fastener 716 is then tightened, arrow rest 708 may be held in the up or down position by vise joint 717 of elevation adjustment bracket 713. As depicted in this illustrative example, arrow rest 708 is held in place by vise joint 717 of elevation adjustment bracket 713 in an up and ready to use position.

In these illustrative examples, elevation adjustment bracket 713 is attached to bracket 718 at bracket member 720 using fastener 722. Fastener 722 may comprise a nut and bolt, or other structure. In these illustrative examples, if fastener 722 is loosened, elevation adjustment bracket 713 may be moved. For example, when fastener 722 is loosened, arrow rest 708 attached to elevation adjustment bracket 713 may be adjusted by a user. In this example, the user may adjust the height of arrow rest 708 by moving elevation adjustment bracket 713 to a position that is optimal for targeting and firing a projectile from slingshot 202. In these illustrative examples, if fastener 722 is tightened, elevation adjustment bracket 713 may be held in place. For example, responsive to a user determining a position of elevation adjustment bracket 713 that is optimal for firing a projectile, the user may then tighten fastener 722 to hold the elevation adjustment bracket 713 in the optimal position. Bracket 718 is fastened to protrusion 208 of elongate member 210 of slingshot 202. Bracket 718 is attached to protrusion 208 using fasteners 214, 216, and 218.

Figure 7B:
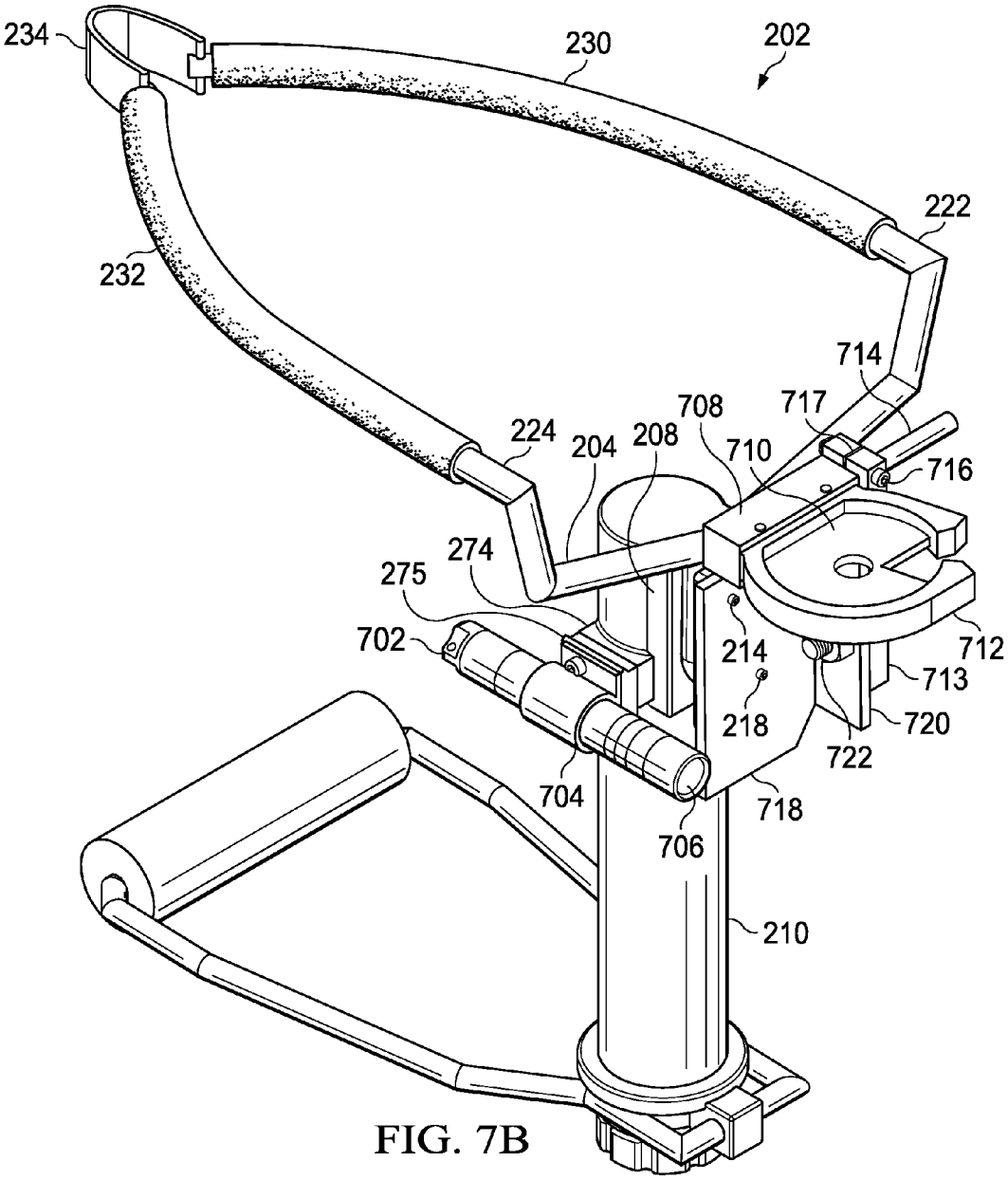
FIG. 7B is an illustration of an isometric view of a slingshot with a flashlight and an arrow rest in accordance with an illustrative embodiment.

Referring now to FIG. 7B, an illustration of an isometric view of a slingshot with a flashlight and an arrow rest in accordance with an illustrative embodiment. Some of the components in FIG. 7B are illustrative examples of the components shown in the isometric view of slingshot 202 of FIG. 2.

As depicted in this illustrative example, arrow rest 708 may be held in place by vise joint 717 of elevation adjustment bracket 713 in a stored position. The stored position depicted in FIG. 7B places arrow rest 708 in a down and out of the way position. For example, arrow rest 708 may be held in the down and out of the way position when firing projectiles other than arrows. The stored position for arrow rest 708 allows a field of vision for the user that is not substantially obstructed by arrow rest 708.

Figure 7C:
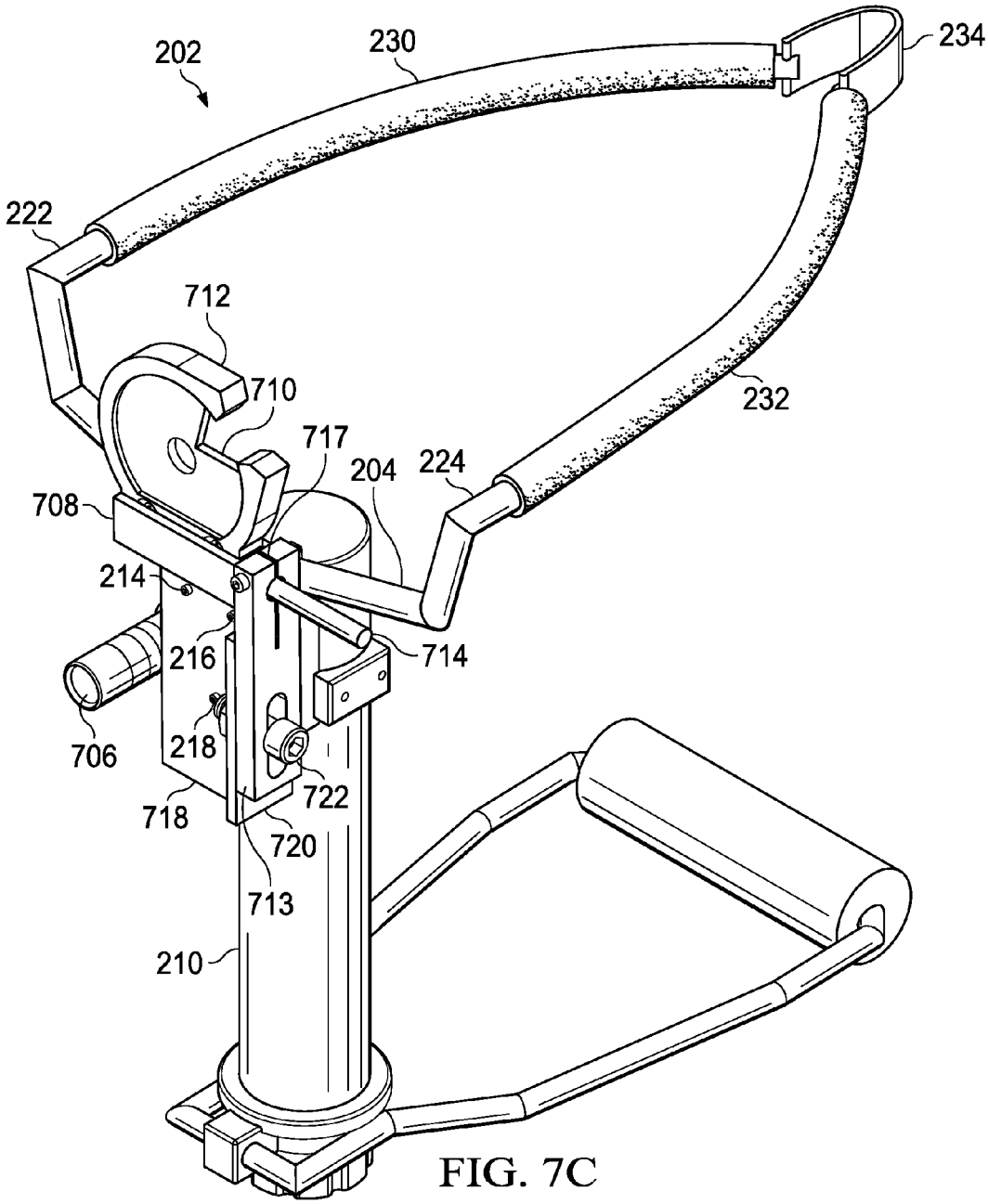
FIG. 7C is an illustration of an isometric view of a slingshot with a flashlight and an arrow rest in accordance with an illustrative embodiment.

Referring now to FIG. 7C, an illustration of an isometric view of a slingshot with a flashlight and an arrow rest in accordance with an illustrative embodiment. Some of the components in FIG. 7C are illustrative examples of the components shown in the isometric view of slingshot 202 of FIG. 2.

As depicted in this illustrative example, arrow rest 708 is held in place by vise joint 717 of elevation adjustment bracket 713 in an up and ready to use position. Arrow rest 708 is mounted to elevation adjustment bracket 713 using rod member 714 of arrow rest 708 and fastener 716. Rod member 714 of arrow rest 708 is inserted into vise joint 717 of elevation adjustment bracket 713 and held in place by vise joint 717 and fastener 716. Elevation adjustment bracket 713 is attached to bracket member 720 of bracket 718 by fastener 722.

The illustrations of slingshot 202 in FIGS. 2-7C are not meant to limit or imply physical or architectural limitations to the manner in which slingshot 202 may be implemented. The different illustrations of slingshot 202 are provided as an example of one physical implementation of slingshot 102 shown in block form in FIG. 1.

For example, fork structure 204 may be removed from protrusion 208 and another suitable structure may be fastened to protrusion 208. Suitable structures are configured to be fastened to protrusion 208 of elongate member 210. Suitable Structures may include other slingshot structures, bows, crossbows, and any other suitable structures that fire projectiles.

Further, protrusion 208 and plate 212 may be configured to fasten additional equipment. Additional equipment may include an arrow rest, a sight, camouflage, and any other suitable equipment.

The illustrative examples disclose a multi-purpose slingshot particularly suited for hunting, fishing, and outdoor survival. Increased power for hunting and fishing may be achieved, in the illustrative examples, using a modular design. A foldable handle and light weight materials are used in the embodiments to allow for a slingshot that is also suitable for travel.

A sealed channel is provided in the slingshot to hold a set of containers. The set of containers can be used to store projectiles, first aid items, survival items, hunting items, and any other suitable items desired for storage by a user. The set of containers are interchangeable and transparent allowing users to rapidly mix, match, and configure what items are stored in the slingshot.

In addition, an accessory system is implemented in the illustrative examples. The accessory system provides multiple locations for mounting equipment on the slingshot. With the accessory system, a variety of equipment can be mounted to the slingshot including, for example, a fishing reel, a flashlight, a stabilizer, a night vision system, a sound amplifier, a laser sight, a rangefinder, and any other suitable equipment.

With a channel in the elongate member of the slingshot and the accessory system, the slingshot may be quickly and easily configured to fulfill a wide variety of purposes for a wide variety of environments.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different advantages as compared to other illustrative embodiments.

The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

an elongate member having a first end and a second end, wherein the elongate member comprises a tube having protrusions;

a first arm extending from the first end;

a second arm extending from the first end, wherein a space is present between the first arm and the second arm over the first end;

a channel extending through the elongate member and in communication with an opening in the second end of the elongate member;

a cap configured to be secured to the second end and substantially seal the opening in the second end, wherein the channel has grooves at the second end and the cap has threads configured to engage the grooves such that the cap is secured to the second end;

a set of containers configured for placement inside of the channel when the cap is secured to the second end, wherein a container in the set of containers is configured to hold an item;

a rail system associated with the elongate member; and a piece of equipment configured to be connected to the rail system.

2. The apparatus of claim 1, wherein a container in the set of containers is configured to be at least one of substantially water tight and substantially transparent.

3. The apparatus of claim 1, wherein the item is selected from one of a projectile, a first aid kit, a knife, food, water, a fishing line, a fishing hook, and a flashlight.

4. The apparatus of claim 1 further comprising:

an elastic band system configured to be connected to the first arm and the second arm.

5. The apparatus of claim 4, wherein the elastic band system comprises:

a receiving structure configured to hold a projectile;

a first elastic band having a first end connected to the receiving structure and a second end connected to the first arm; and a second elastic band having a first end connected to the receiving structure and a second end connected to the second arm.

6. The apparatus of claim 1, wherein the first arm and the second arm are part of a fork structure attached to the elongate member.

7. The apparatus of claim 1, wherein the elongate member is comprised of a material selected from one of a metal, an alloy, a composite material, polycarbonate, aluminum, steel, carbon fiber, and titanium.

8. The apparatus of claim 1, wherein the piece of equipment is selected from one of a fishing reel, a flashlight, an aiming stabilizer, a night vision aid, a sound amplifier, a laser sight, a rangefinder, a projectile container, and an arrow quiver.

9. A sling shot system comprising:

a tube having a first end and a second end;

a first arm extending from the first end;

a second arm extending from the first end, wherein a space is present between the first arm and the second arm over the first end;

a channel extending through an elongate member and in communication with an opening in the second end of the elongate member;

a cap configured to be secured to the second end and substantially seal the opening in the second end;

a sealing mechanism configured to seal the channel when the cap is secured to the second end;

a set of containers configured for placement inside of the channel when the cap is secured to the second end, wherein a container in the set of containers is configured to hold an item;

a rail system associated with the elongate member; and a piece of equipment configured to be connected to the rail system.

10. The sling shot system of claim 9, wherein a container in the set of containers is configured to be at least one of substantially water tight and substantially transparent.

11. The sling shot system of claim 9 further comprising:

an elastic band system configured to be connected to the first arm and the second arm.

12. The sling shot system of claim 9, wherein the piece of equipment is selected from one of a fishing reel, a flashlight, an aiming stabilizer, a night vision aid, a sound amplifier, a laser sight, a rangefinder, a projectile container, and an arrow quiver.

13. The sling shot system of claim 9, wherein the elongate member is comprised of a material selected from one of a metal, an alloy, a composite material, polycarbonate, aluminum, steel, carbon fiber, and titanium.

* * * * *